US009627156B2

(12) United States Patent
Koepsell

(10) Patent No.: US 9,627,156 B2
(45) Date of Patent: Apr. 18, 2017

(54) SNAP-ACTION SWITCH

(71) Applicant: Johnson Electric S.A., Murten (CH)

(72) Inventor: Martin Koepsell, Ennepetal (DE)

(73) Assignee: Johnson Electric S.A., Murten (CH)

( * ) Notice: Subject to any disclaimer, the term of this patent is extended or adjusted under 35 U.S.C. 154(b) by 0 days.

(21) Appl. No.: 14/532,837

(22) Filed: Nov. 4, 2014

(65) Prior Publication Data

US 2015/0122620 A1 May 7, 2015

(30) Foreign Application Priority Data

Nov. 5, 2013 (DE) ..... 10 2013 018 448

(51) Int. Cl.

*H01H 9/00* (2006.01)
*H01H 5/04* (2006.01)
*H01H 1/58* (2006.01)

(52) U.S. Cl.

CPC ..... *H01H 5/04* (2013.01); *H01H 1/5805* (2013.01); *H01H 2001/5816* (2013.01); *H01H 2207/04* (2013.01); *Y10T 29/49105* (2015.01)

(58) Field of Classification Search

CPC ..... H01H 2229/038
USPC ..... 200/292, 513; 29/622
See application file for complete search history.

(56) References Cited

U.S. PATENT DOCUMENTS

| | | | | |
|---|---|---|---|---|
| 4,066,851 | A * | 1/1978 | White | H01H 1/403 200/292 |
| 4,349,712 | A | 9/1982 | Michalski | |
| 8,053,693 | B2 | 11/2011 | Bertram et al. | |
| 8,129,643 | B2 | 3/2012 | Anzai et al. | |
| 2012/0285812 | A1 | 11/2012 | Sekiguchi et al. | |

FOREIGN PATENT DOCUMENTS

| | | | |
|---|---|---|---|
| DE | 29 02 769 | A1 | 7/1980 |
| DE | 39 19 099 | A1 | 12/1990 |
| DE | 10 2006 043 795 | B3 | 5/2008 |
| DE | 10 2007 049 692 | A1 | 4/2009 |
| DE | 10 2008 035 043 | A1 | 2/2010 |
| DE | 10 2012 005 964 | A1 | 9/2013 |
| DE | 10 2012 007 075 | A1 | 10/2013 |

* cited by examiner

*Primary Examiner* — Vanessa Girardi
(74) *Attorney, Agent, or Firm* — Muncy, Geissler, Olds & Lowe, P.C.

(57) ABSTRACT

A snap-action switch has at least two switching contacts, at least one flexible circuit carrier carrying conductor tracks and at least one multifunction component receiving the flexible circuit carrier. The switching contacts and the conductor tracks are connected with each other via a non-detachable connection. The region of the flexible circuit carrier between the switching contacts is configured as a bending tab.

11 Claims, 7 Drawing Sheets

SNAP-ACTION SWITCH

CROSS REFERENCE TO RELATED APPLICATIONS

This non-provisional patent application claims priority under 35 U.S.C. §119(a) from Patent Application No. 102013018448.7 filed in Germany on Nov. 5, 2013, the entire contents of which are hereby incorporated by reference.

FIELD OF THE INVENTION

This invention relates to a snap-action switch with at least two switching contacts, at least one flexible circuit carrier carrying conductor tracks and at least one multi-function component receiving the flexible circuit carrier. In addition this invention relates to a method of manufacturing a snap-action switch from at least two switching contacts and at least one flexible circuit carrier carrying conductor tracks.

BACKGROUND OF THE INVENTION

Generic snap-action switches, also known as "jump" switches, are switches where the switching positions are formed by reversible geometry changes of their movable switching contacts. When switching these snap-action switches the switching positions are converted into electrical signals. A snap-action switch is characterized in that, at a certain position of an actuating structure, it automatically and abruptly generates a change in switching state. Of all switch types, snap-action switches are closest to the mathematically ideal snap-action function of a switch.

The behavior of switches with sliding contacts is regularly dependent on the movement of an actuation structure over a dead path. While in the dead path of the actuating structure both the opening and the closing circuits are open so that the actuating structure may have a negative influence upon the switchover time. Snap-action switches do not suffer from this disadvantage. With snap-action switches the movable switching contact has a constant switchover time known as snap-action time, in which both the opening and the closing circuits are open. The service life of switches with sliding contacts is substantially limited by abrasions occurring on the sliding contacts. In the course of this service life the electric characteristic values deteriorate as a result of this wear from abrasion, in particular the resistance of the switch deteriorates depending on the number of actuating and temperature cycles of switching operations carried out. In order to reduce this wear on the sliding contacts, it is known to lubricate these with lubricants. At low temperatures, when the viscosity of the lubricant is reduced, the electric characteristic values deteriorate, in particular electric resistances rise and the switchover times of switches lengthen.

Snap-action switches are regularly used as signal switches for low direct currents, where bounce time is an important functional criterion. The bounce time is an indication for the time duration which a switching contact, after starting the snap-action operation, requires until an electrical signal is stable. Apart from the actual bouncing operation, recording also encompasses other parameters such as surface effects, including breaking through covering layers at the switching contacts, pushing lubricant out of the contact region and abrading corrosion products on the switching contacts. Due to these surface effects switches with sliding contacts comprise a bounce time which, in particular at low temperatures, is greater than the bounce time of snap-action switches. In order to improve electric conductivity between the switching contacts, their contact surfaces are normally coated galvanically with gold or silver. Gold is used, in particular, on contact surfaces which require a maximum of corrosion resistance. The use of precious metals however makes manufacture of the switches very expensive.

German patent specification DE 10 2006 043 795 B3 and the associated U.S. Pat. No. 8,053,693 B2 both disclose an electric micro switch the switching contacts of which comprise a special surface structure for reducing the bounce time and its contact surfaces are selectively electroplated for minimizing precious metal consumption. For a large-scale production of these switches the contact surfaces are normally electroplated using a punch strip. This technique known as continuous electroplating represents a highly productive and cost-efficient manufacturing method which is suitable in particular for selective coatings and smallest coating thicknesses. However continuous electroplating is a highly specialized and capital-intensive manufacturing process which requires setting up an external supply chain. Such supply chains are however disadvantageous when aiming at vertical manufacturing depth, small batch sizes, low stocks and flexibility in changing process variables.

Known snap-action switches comprise a plurality of components. The German patent specification DE 10 2008 035 043 B4 has disclosed a snap-action switch which is built into a carrier component and is electrically connected with a circuit by soldering, welding or clamping. In order to protect the junctions against moisture and other environmental influences, these are encapsulated in a housing. The junctions however remain a cause for functional failure.

In principle all snap-action switches with metallic contacts and all sliding switches generate switching noises. In many areas however, the demand is now for low-noise or nearly noiseless switches because noises arising from switch actuation are perceived as increasingly annoying. As an example we would mention vehicles with an automatic start-stop system or electrical vehicles where switching noises are audible which are reliably masked in vehicles with conventional combustion engines.

Rating of switches is effected with respect to their weight, their use of energy, their material consumption as well as the number of manufacturing steps required. Advantages compared to classical solutions with carrier components, punched circuit carriers or circuit boards, seals and plugs are offered by a constructive integration of individual switch functions into the flexible circuit carrier.

The German laid-open specification DE 10 2012 005 964 A1 and the German patent application with reference no. 10 2012 007 075.6 both describe switch arrangements, where connection contacting of the switching contacts with the conductor tracks is omitted. In these switch arrangements the flexible circuit carriers assume the function of the switching contacts thereby eliminating the risk of failure originating from the junctions. Even encapsulating the junctions with a plastic may be waived because the flexible circuit carrier is normally provided with a protective coating. In all, because functions are redistributed in these switch arrangements, material consumption is reduced, as is the weight.

The German laid-open specification DE 10 2007 049 692 A1 has disclosed a snap-action switch which is soldered onto a circuit board by means of SMD technology. With this design the number of components, albeit, is reduced, but it comprises soldering points which are susceptible to failure. A further embodiment of a snap-action switch acting as a push-button switch is known from the U.S. Pat. No. 8,129, 643 B2, where the basic element is a snap disc, but the number of components could not be reduced.

SUMMARY OF THE INVENTION

There is a desire for a simple and reliable snap-action switch, which is composed of a minimum of parts.

Accordingly, in a first aspect thereof, the invention provides a snap-action switch with at least two switching contacts, at least one flexible circuit carrier carrying conductor tracks and at least one multifunction component receiving the flexible circuit carrier, wherein the switching contacts and the conductor tracks are connected with each other via a non-detachable connection, and the at least one region of the flexible circuit carrier between the switching contacts is configured as a bending tab.

Thus in the simplest case, the snap-action switch according to the invention is composed of only two components, wherein one of the components is the multifunction component and the other is the flexible circuit carrier. In order to achieve its function as per the invention the bending tab is exposed to a bending or buckling stress by tensioning the flexible circuit carrier in the multifunction component, thereby creating an energy potential transmitter for the snap action function in order to effect a reversible geometry change. Together with the bending tab the flexible circuit carrier plays an important and direct part in the configuration of the switching mechanics. With a construction composed of very few, in particular two components the snap-action switch according to the invention is constructed in a very simple, weight-reduced and reliably working manner. In addition the snap-action switch according to the invention, due to its small number of components, is extraordinarily insensitive to variations in size due to the manufacturing process and permits maximum weight reduction for a minimum of material used.

According to a first further development of the invention the switching contacts are print-ons applied to the conductor tracks of the flexible circuit carrier. With the print-ons the configuration of the switching contacts is preferably part of the manufacture of the circuit carrier and is no longer part of the assembly process of the snap-action switch according to the invention. The snap-action switch according to the invention therefore does not comprise any connection contacting between its switching contacts and its flexible circuit carrier resulting in a complete lack of error potential. The manufacture of the conductor tracks is preferably effected by coating the entire area of the carrier material by means of an electric conductor such as copper and then removing the copper by etching the spaces between the conductor tracks. Alternatively the conductor tracks may be manufactured by applying print-ons to the flexible circuit carrier. Manufacture of the switching contacts is also partially effected by print-ons applied to the conductor tracks of the flexible circuit carrier, wherein one of the switching contacts is a silver print-on and the respectively other switching contact is a carbon print-on. With the silver and copper material pairing in the contact region of the switching contacts the snap-action switch according to the invention comprises an almost constant bounce time as well as an almost constant electric resistance over its entire period of use. By using switching contacts produced by way of printing and conductor tracks also produced by way of printing there is, advantageously, no longer any need for electroplating individual components or regions of the snap-action switch according to the invention. In addition the flexible circuit carrier comprises a coating with cut-outs for the switching contacts, and this coating protects the conductor tracks thereof against environmental influences.

In an alternative configuration of the switching contacts provision is made for the switching contacts to comprise contact bodies applied to the conductor tracks. These allow, in particular, the switching contacts to be configured as contacts which have mass and which are spaced further apart, and which are, for example, suitable for switching higher power currents, e.g. for operating light switches. In order to apply the contact bodies to the conductor tracks the contact bodies are provided with contact profiles for cooperation with the conductor tracks across extensive areas.

According to a next further development of the invention the conductor tracks are formed on at least one side of the flexible circuit carrier, wherein the flexible circuit carrier comprises at least one turn-over fold formed between its switching contacts. The turn-over fold is used to spatially bring the switching contacts together for the purpose of direct contacting. A particularly flat shape for the snap-action switch according to the invention is achieved if the turn-over fold is designed with a sharp edge and areally adjacent circuit carrier areas. On the other hand, it is well within the scope of the invention to configure the turn-over fold as a soft bending fold with a loop-shaped circuit carrier area. The turn-over fold advantageously permits the use of easy-to-produce flexible circuit carriers with only a single conductor track plane for, at the same time, a constructionally simple design of the inventive snap-action switch.

According to a next further development of the invention the flexible circuit carrier comprises at least two circuit carrier portions which overlap each other, wherein the switching contacts are arranged on the sides of the circuit carrier portions facing each other in the overlapping region. The overlapping circuit carrier portions are tabs formed either in the middle or on the edge of the flexible circuit carrier.

With the snap-action switch according to the invention a bi-stable switching characteristic is achieved in that a knocking tab is formed with at least one of the overlapping circuit carrier portions of the flexible circuit carrier, which is held under tension in the multifunction component via the bending tab. The knocking tab ensures that ideally no relative movements occur between the switching contacts during opening and closing of a circuit, thereby preventing any possible wear due to abrasion in the contact region of the switching contacts. Due to the switching contacts areally knocking against each other the snap-action switch according to the invention advantageously comprises a short bounce time and generates very little noise. Any switching noises which might occur, can be advantageously dampened by selecting sound-absorbing plastics for the carrier material of the flexible circuit carrier. The short bounce times mean that the snap-action switch according to the invention is suitable also for switching signal currents which is a very challenging activity. The snap-action function is achieved in that the multifunction component makes the bending tab of the snap-action switch according to the invention bend or buckle, and the restoring force of this creates a triangle of forces between the multifunction component, the knocking tab and the bending tab, in which an elastic deformation of the flexible circuit carrier leads to an abrupt direction reversal of the resultant load from the triangle of forces. With the bi-stable switching characteristic such a direction reversal of the resultant load causes the knocking tab to immediately change from one switching position to the other, respectively.

According to a next further development of the invention the multifunction component comprises at least one actuating structure engaging on the bending tab of the flexible circuit carrier and comprising a travel path which is guided from one side over to the other side of the knocking tab. On this travel path takes place the movement which leads to the elastic deformation of the flexible circuit carrier and thus to a direction reversal of the resultant load from the triangle of forces, and finally, with an abrupt turn-over movement of the knocking tab, to a planned switching operation between the switching contacts. The actuating structure is preferably an actuating arm from a material with elastic properties, formed on the multifunction component. During actuation of the actuating structure this acts as a return spring the restoring force of which must be temporarily overcome in order to switch the snap-action switch with a force initiated at the actuating structure.

If the snap-action switch according to the invention is to be configured as a pushbutton switch it is proposed to provide the actuating structure of the multifunction component with at least one finger-actuated touch surface. Taking into account the known areas of use for the snap-action switch, however, it lies within the scope of the invention to equip the actuating structure with a surface on which automatically actuated control elements can engage.

In order to increase the opening and closing forces necessary for operating the snap-action switch as well as the necessary contact pressure forces between the switching contacts when using thin flexible circuit carriers, in particular so-called conductor films, it is proposed according to a next further development of the invention, that the flexible circuit carrier comprises a reinforcement layer at least in the region of the bending tab. Such reinforcement layers are for example coatings from materials with which the flexible circuit carrier can be stiffened in the region of the bending tab. Material suitable for such a reinforcement layer are in particular metals and plastics with spring-elastic properties.

As regards the method according to the invention, the invention is characterized in that initially the switching contacts are non-detachably connected with the conductor tracks of the flexible circuit carrier, that the switching contacts are approximated to one another by folding the printed circuit carrier, and that the approximated switching contacts are tensioned against each other by bending the folded circuit carrier. Folding the circuit carrier is based on folding over one or more portions of the circuit carrier and this is preferably a first step in the assembly process of the switch manufacture. The folding process is intended to bring the switching contacts spatially together so that these come into contact with one another for closing a circuit. The activity of folding implies descriptions such as turning, bending, folding down, turning down of portions of the flexible circuit carrier. The tensioning force necessary for bracing the flexible circuit carrier against the multifunction component is a restoring force which originates from the bending or buckling tension generated by the bending load in the circuit carrier. Bracing the flexible circuit carrier against the multifunction component is based on bending or buckling one or more portions of the circuit carrier and is an essential step in the assembly process during the switch manufacture. When bracing the approximated switching contacts against each other the knocking tab is moved into one of its switching positions, preferably into the switching position in which the switching contacts are separated from each other.

In the simplest case therefore the method according to the invention comprises only two assembly steps, wherein the first assembly step comprises folding the circuit carrier holding the switching contacts as one piece, and the second assembly step comprises bending or buckling the folded circuit carrier. Due to the method comprising only a few, in particular just two simple assembly steps the process chain required for manufacturing the snap-action switch according to the invention is advantageously short, resulting in correspondingly low investment requirements for setting up the process chain.

According to a first further development of the method according to the invention the switching contacts are printed on to the conductor tracks of the flexible circuit carrier. Manufacture of the switching contacts is preferably effected using precious metal or carbon-containing printing pastes which are applied for example by screen printing onto the flexible circuit carrier.

An alternative of how to produce the one-piece connection consists in joining the switching contacts and the conductor tracks of the flexible circuit carrier together. Suitable joining techniques consist in areally soldering, bonding or riveting the switching contacts to the conductor tracks.

According to another further development of the method according to the invention at least one folding template is cut to size from the flexible circuit carrier, and printing and folding of the flexible circuit carrier is then performed on the folding template. Cutting to size of the flexible circuit carrier is preferably performed using a punching tool. But in principle there are other suitable separating techniques which may be used. Cutting the flexible circuit carrier to size is used, in particular, to form the tabs which are used by the flexible circuit carrier for crucially and directly participating in the configuration of the switching mechanics.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
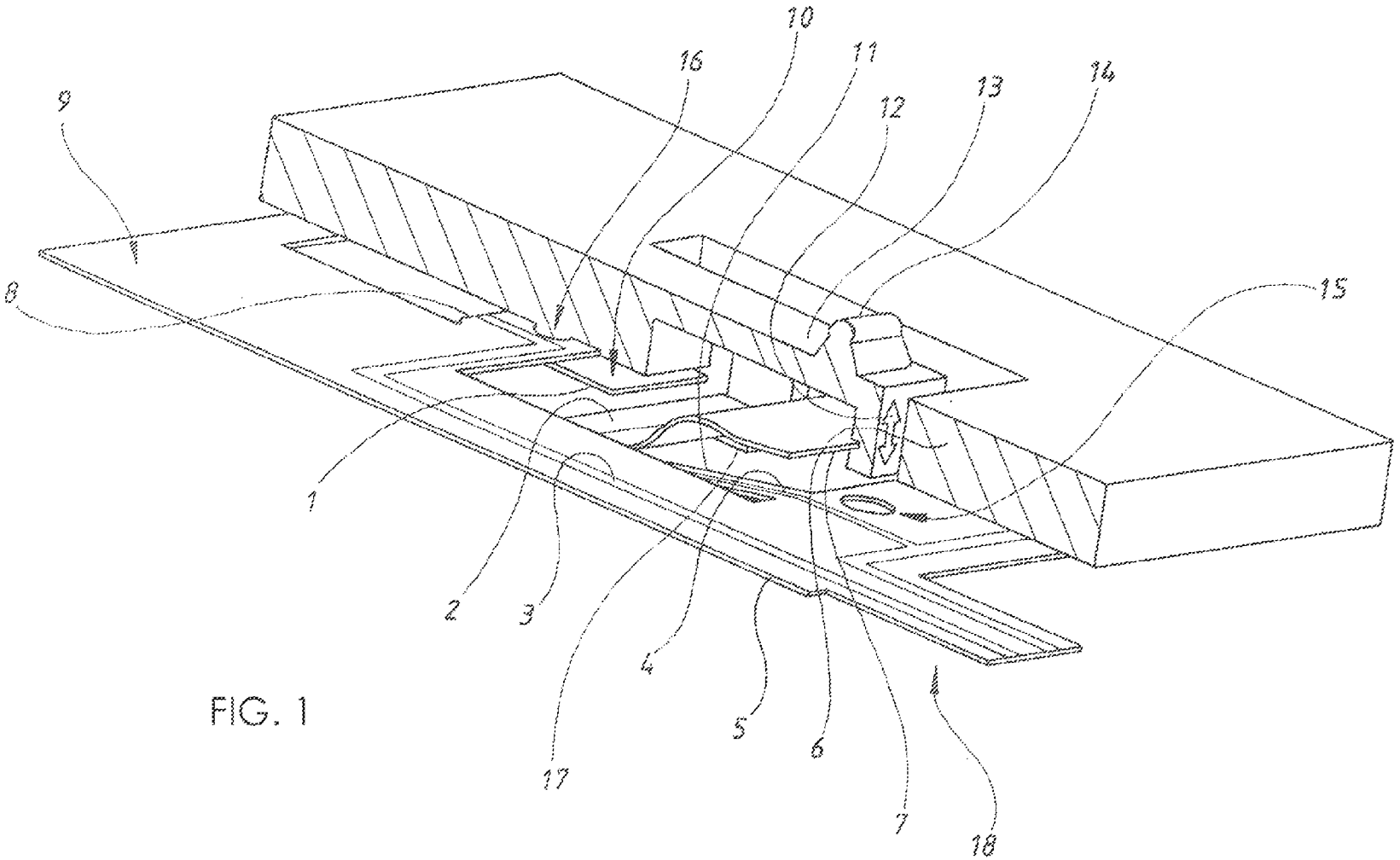
FIG. 1 shows a perspective partial view of a snap-action switch according to the invention in an inoperative switching position.
Figure 7:
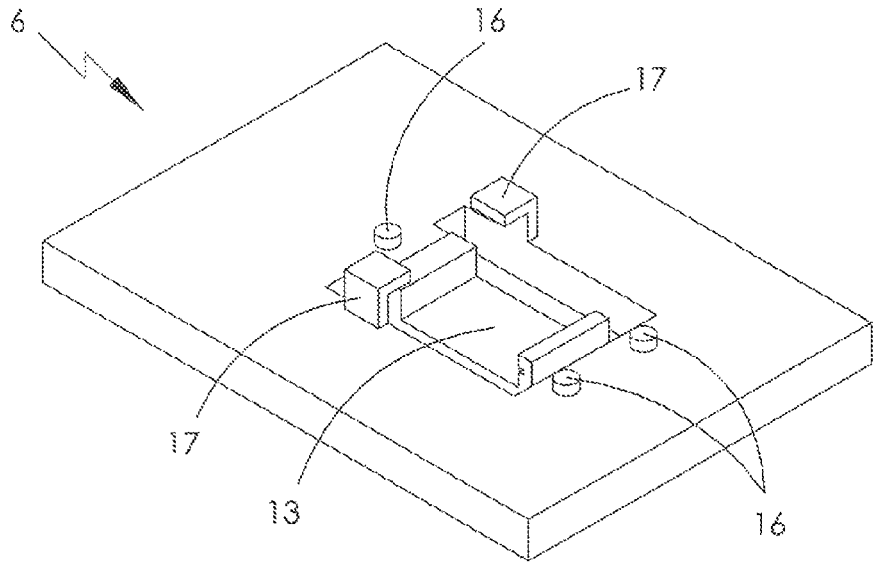
FIG. 7 shows a perspective view from below a multifunction component, forming a part of the switch of FIG. 1.
Figure 8:
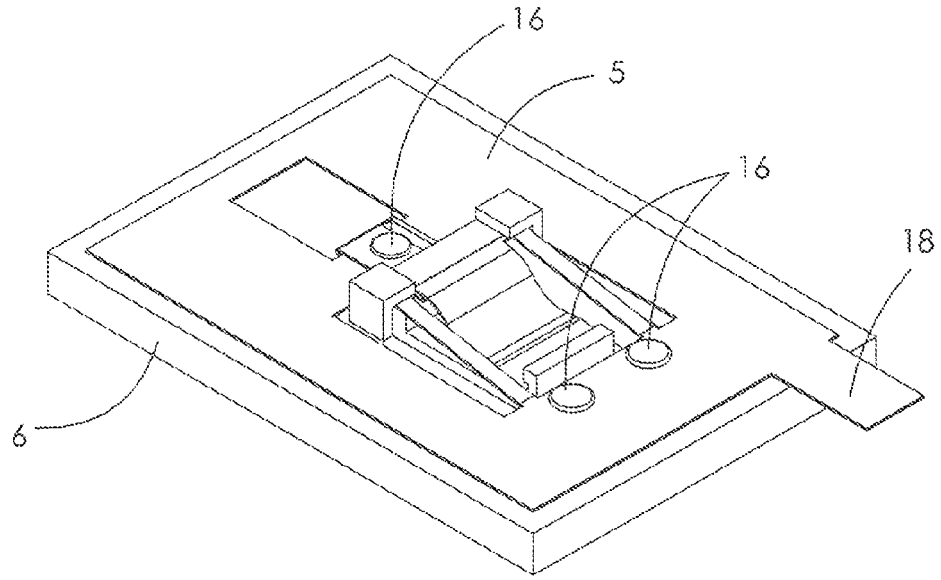
FIG. 8 shows a perspective view from below of the multi-function component fitted with the flexible circuit carrier.

FIG. 1 shows a perspective partial view of a snap-action switch according to the invention, with two switching contacts 1, 2, a flexible circuit carrier 5 having conductor tracks 3, 4 and a multi-function component 6 receiving the flexible circuit carrier 5. For better understanding of the constructional switch design, FIG. 1 shows only one half of the multi-function component 6 divided into two halves by a mirror-symmetrical section. The underside of the multi-function component is shown in FIG. 7 and the underside of the assembled switch is shown in FIG. 8. The switching contacts 1, 2 are print-ons applied to the conductor tracks 3, 4 of the flexible circuit carrier 5. A region of the flexible circuit carrier 5 between the switching contacts 1, 2 is configured as a bending tab 7. Since the conductor tracks 3, 4 are both formed on the same side of the flexible circuit carrier 5, the carrier comprises a turn-over fold 8 formed between its switching contacts 1, 2. In addition the flexible circuit carrier 5 comprises two overlapping circuit carrier portions 9, 10, wherein the switching contacts 1, 2 lie on the sides of the circuit carrier portions 9, 10 facing each other in the overlapping region. With one of the circuit carrier portions 9, 10 of the flexible circuit carrier 5 a knocking tab 11 is formed, which is tensioned in the multi-function component 6 via the bending tab 7. The multi-function component 6 comprises an actuating structure 13 engaging on the bending tab 7 of the flexible circuit carrier 5, and having a travel path as per double arrow 12, wherein the travel path is guided from one side over to the other side of the knocking tab 11. The actuating structure 13 of the multi-function component 6 comprises a finger-actuated touch surface 14. In FIG. 1 a switching position opening the switching contacts 1, 2 is shown, where the touch surface 14 of the actuating structure 13 is not actuated. Attachment points 15, 16 formed between the multi-function component 6 and the flexible circuit carrier 5 as well as two knocking tab limiters 17 associated with the knocking tab 11 act as abutments for maintaining a folding load acting upon the bending tab 7. In order to connect the snap-action switch according to the invention with an electric circuit the flexible circuit carrier 5 comprises a connecting tab 18 receiving the free conductor track ends of the conductor tracks 3, 4.

Figure 2:
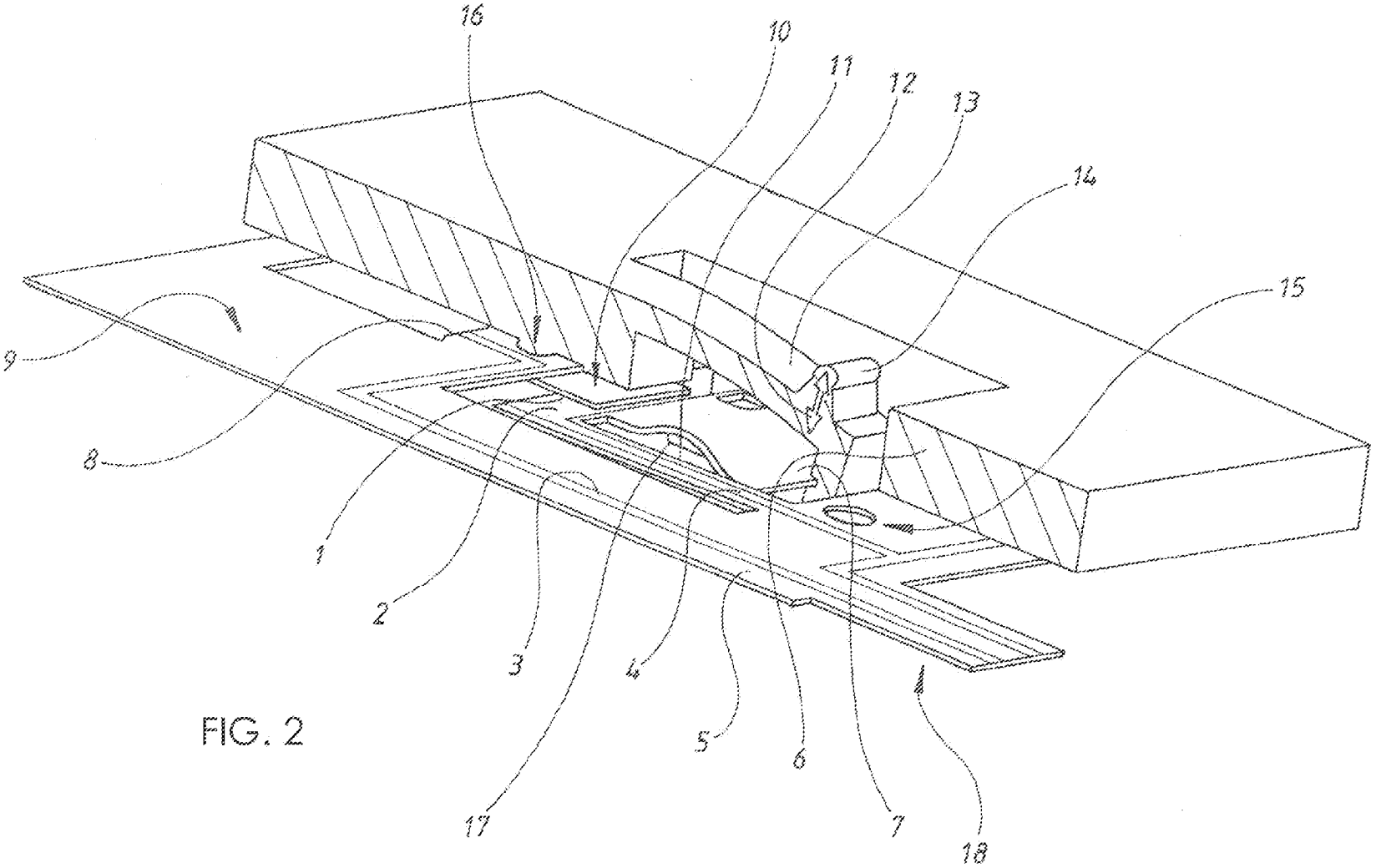
FIG. 2 shows a perspective partial view of a snap-action switch according to FIG. 1, but in an operative switching position.

FIG. 2 also shows a perspective view of a snap-action switch according to the invention, however the snap-action switch in this view is shown in a switching position for closing the switching contacts 1, 2, in which the touch surface 14 of the actuating structure 13 is actuated by a power source not shown. Again the figure shows only one half of the multi-function component 6 which is divided in two halves by a mirror-symmetrical section. Identical components are marked with the same reference numbers.

FIGS. 3 to 6 show the flexible circuit carrier 5 in four consecutive processing steps over time.

Figure 3:
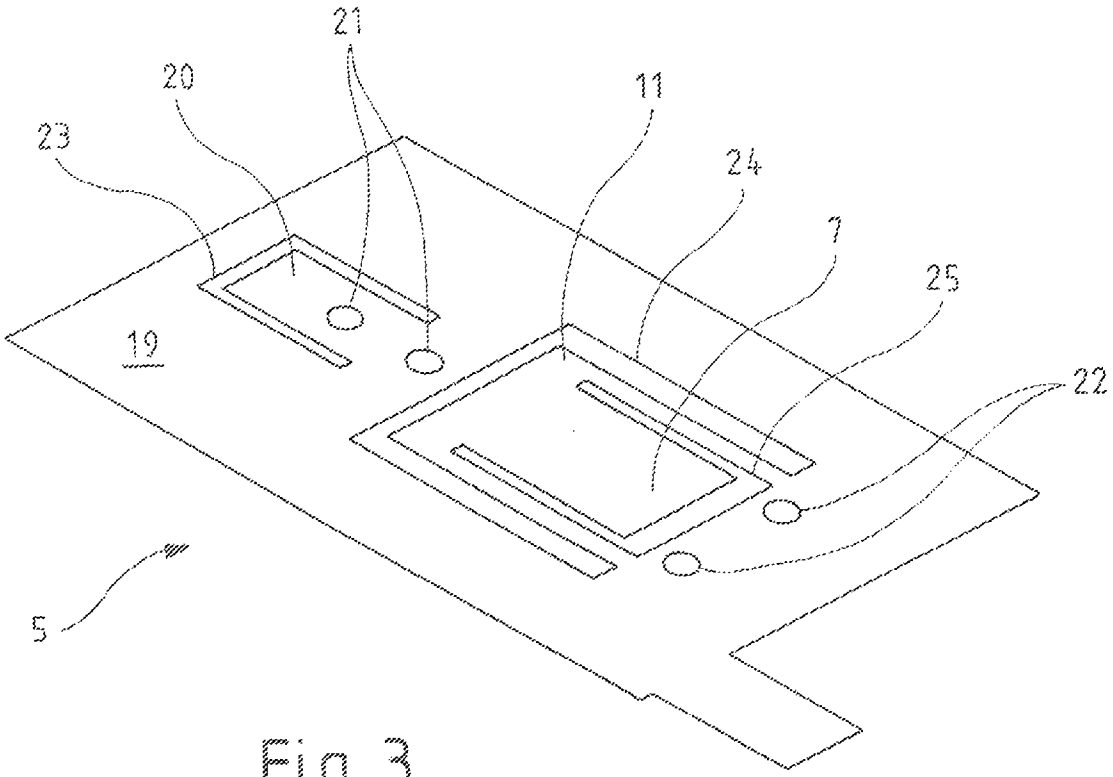
FIG. 3 shows a perspective view of a flexible circuit carrier cut to size for forming a folding template.

According to a first processing step shown in FIG. 3 a folding template 19 has been cut from the flexible circuit carrier 5. From the blank were formed on the flexible circuit carrier 5: the bending tab 7, the knocking tab 11, a folding tab 20, four fastening cut-outs 21, 22 as well as the connecting tab 18, wherein the bending tab 7, the knocking tab 11 and the folding tab 20 are each limited by a U-shaped cut-out 23, 24, 25.

Figure 4:
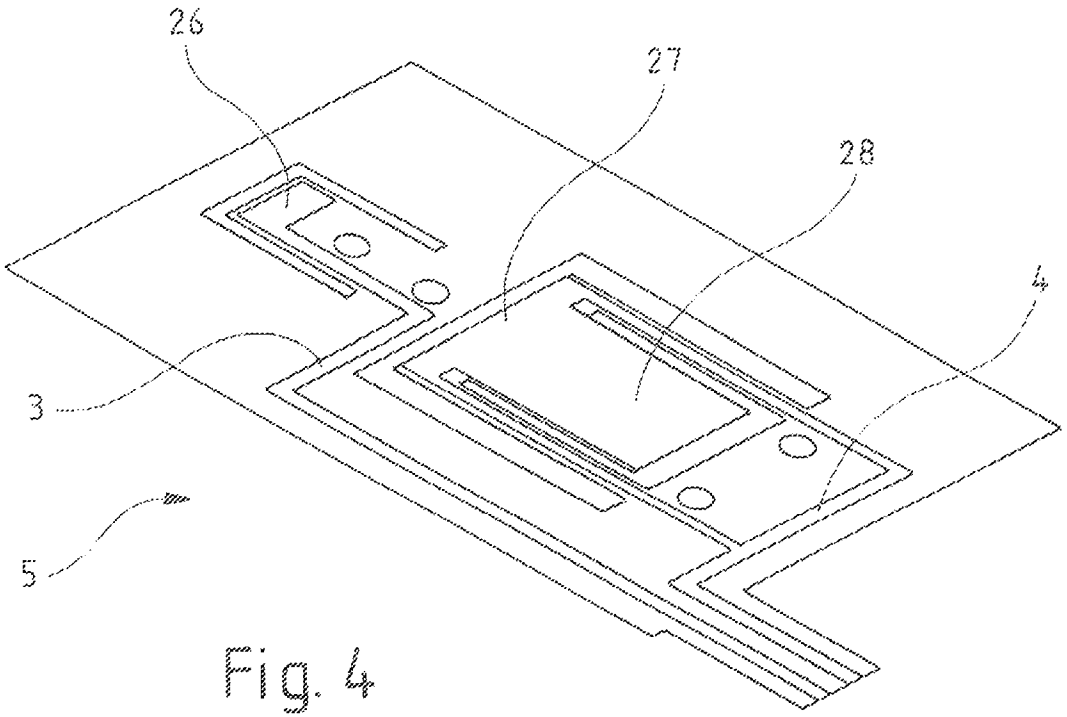
FIG. 4 shows a perspective view of the flexible circuit carrier according to FIG. 3, with conductor tracks applied.

According to a second processing step shown in FIG. 4 the conductor tracks 3, 4 are applied to the flexible circuit carrier 5. Whilst the conductor track 3 has a functional surface 26 provided on the folding tab 20, the conductor track 4 comprises a functional surface 27 provided on the knocking tab 11. In addition the conductor track 4 comprises a conductor extension extending areally on the bending tab 7, which is configured as a reinforcement layer 28 reinforcing the bending tab 7.

Figure 5:
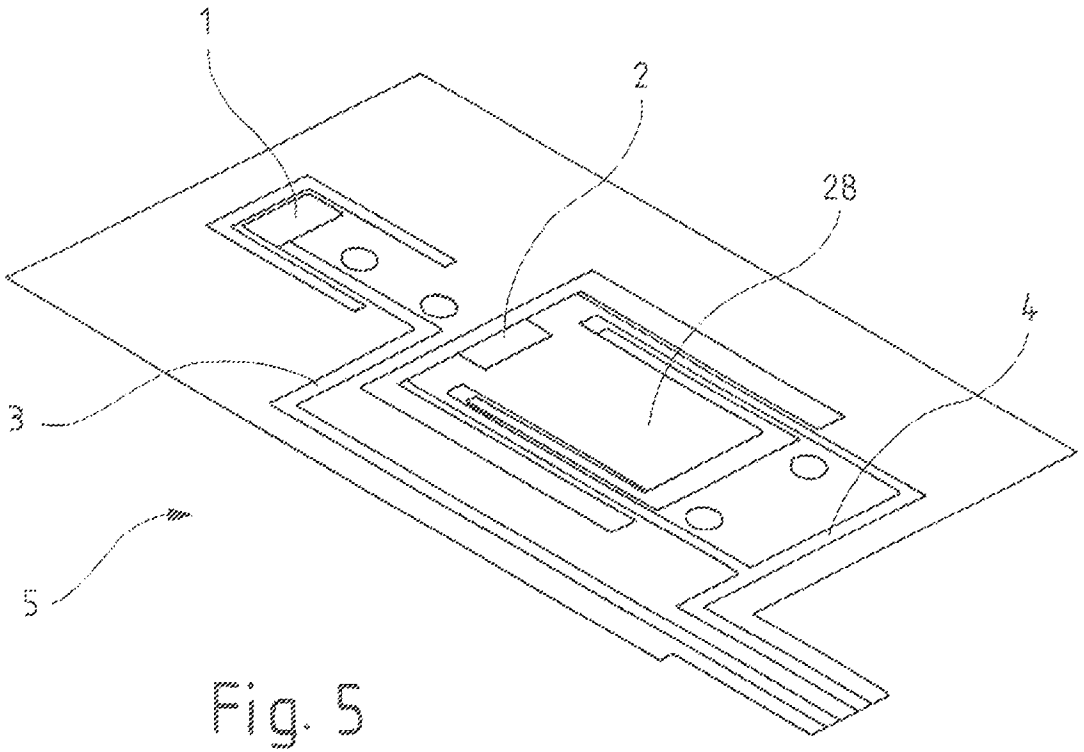
FIG. 5 shows a perspective view of the flexible circuit carrier according to FIG. 4, with switching contacts applied.

According to a third processing step shown in FIG. 5 the switching contacts 1, 2 are printed onto the functional surfaces 26, 27 (see FIG. 4) of the conductor tracks 3, 4. Whilst the switching contact 1 comprises printed-on silver the switching contact 2 comprises printed-on carbon.

Figure 6:
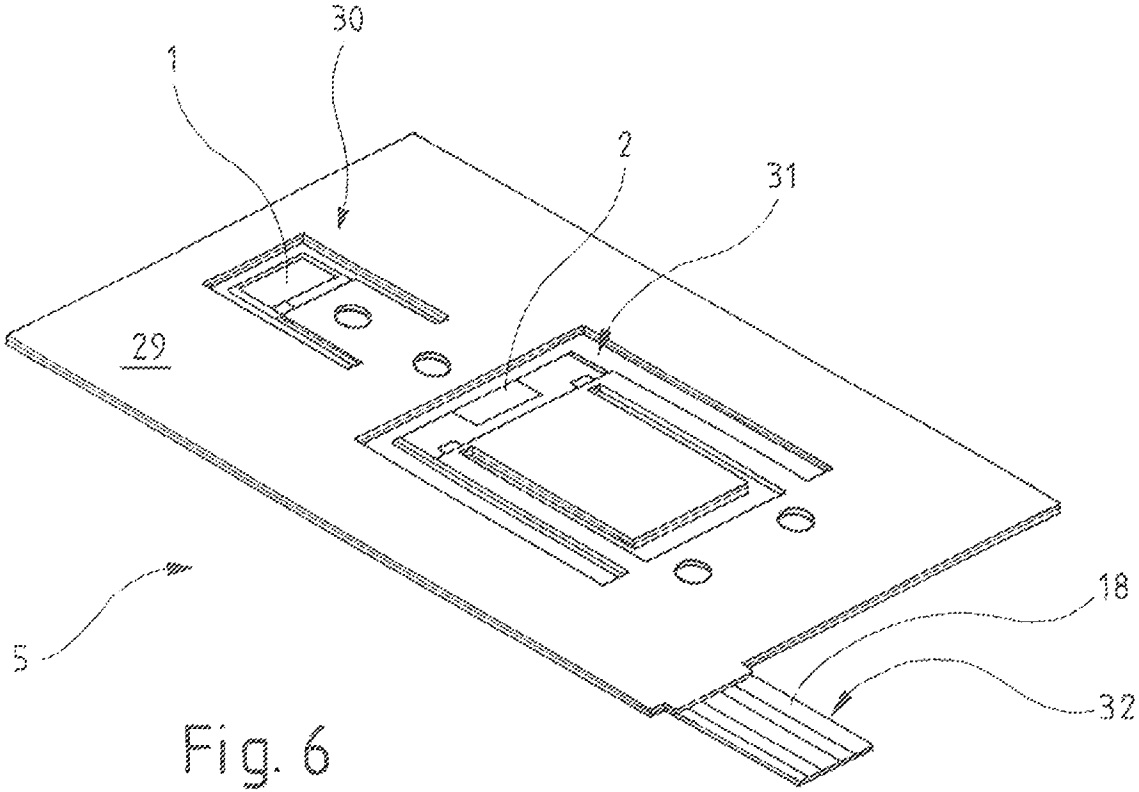
FIG. 6 shows a perspective view of the flexible circuit carrier according to FIG. 5, with a protective coating applied.

According to a fourth processing step shown in FIG. 6 the flexible circuit carrier 5 is provided with a protective coating 29 covering the conductor tracks 3, 4, which coating comprises cut-outs 30, 31, 32 exposing the switching contacts 1, 2 as well as the connecting tab 18. The flexible circuit carrier 5 shown in FIG. 6 is one of the components to be kept ready for assembling the switch according to the invention as shown in FIGS. 1 and 2.

All features mentioned in the above description and in the claims can be combined selectively at random with the features of the independent claim. The disclosure of the invention is therefore not limited to the described/claimed feature combinations, rather all feature combinations relevant in terms of the invention are to be considered as disclosed.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined by the appended claims.

The invention claimed is:

1. A snap-action switch with at least two switching contacts, at least one flexible circuit carrier carrying conductor tracks and at least one multifunction component receiving the flexible circuit carrier, wherein the switching contacts and the conductor tracks are connected with each other via a non-detachable connection, and the at least one region of the flexible circuit carrier between the switching contacts is configured as a bending tab, the flexible circuit carrier comprises at least two circuit portions overlapping each other, and in that the switching contacts are arranged on the sides of the circuit carrier portions, facing each other in the overlapping region, and at least one of the overlapping circuit carrier portion of the flexible circuit carrier forms a knocking tab which is tensioned in the multifunction component via the bending tab.

2. The snap-action switch of claim 1, wherein the multi-function component comprises at least one actuating structure engaging on the bending tab of the flexible circuit carrier, which structure comprises a travel path which is guided from one side over to the other side of the knocking tab.

3. The snap-action switch of claim 2, wherein the actuating structure of the multifunction component comprises at least one finger-actuated touch surface.

4. The snap-action switch of claim 1, wherein the switching contacts are print-ons applied to the conductor tracks of the flexible circuit carrier.

5. The snap-action switch of claim 1, wherein the switching contacts are contact bodies applied to the conductor tracks.

6. The snap-action switch of claim 1, wherein the conductor tracks are formed on at least one side of the flexible circuit carrier and in the flexible circuit carrier comprises at least one turn-over fold formed between its switching contacts.

7. The snap-action switch of claim 1, wherein the flexible circuit carrier comprises a reinforcement layer formed at least in the region of the bending tab.

8. A method for manufacturing a snap-action switch from at least two switching contacts and at least one flexible circuit carrier carrying conductor tracks, in particular for manufacturing the snap-action switch, wherein the switching contacts and the conductor tracks are connected with each other via a non-detachable connection, and the at least one region of the flexible circuit carrier between the switching contacts is configured as a bending tab, the flexible circuit carrier comprises at least two circuit portions overlapping each other, and in that the switching contacts are arranged on the sides of the circuit carrier portions, facing each other in the overlapping region, and at least one of the overlapping circuit carrier portion of the flexible circuit carrier forms a knocking tab which is tensioned in the multifunction component via the bending tab, the switching contacts are being positioned opposite one another by folding the printed circuit carrier, and the switching contacts are lied on the sides of the circuit carrier portions facing each other in the overlapping region.

9. The method claim 8, wherein the switching contacts are printed onto the conductor tracks of the flexible circuit carrier.

10. The method of claim 8, wherein the switching contacts and the conductor tracks of the flexible circuit carrier are joined together.

11. The method of claim 8, wherein at least one folding template is cut from the flexible circuit carrier, and in that printing and folding of the flexible circuit carrier is performed on the folding template.

* * * * *